US011140949B2

(12) United States Patent
Hung

(10) Patent No.: US 11,140,949 B2
(45) Date of Patent: Oct. 12, 2021

(54) DOCK SLIDER

(71) Applicant: IDEAL FASTENER (JIANGSU) LTD., Jiangyin (CN)

(72) Inventor: Franklin Chi Yen Hung, Jiangyin (CN)

(73) Assignee: IDEAL FASTENER (JIANGSU) LTD., Jiangyin (CN)

( * ) Notice: Subject to any disclaimer, the term of this patent is extended or adjusted under 35 U.S.C. 154(b) by 0 days.

(21) Appl. No.: 16/764,507

(22) PCT Filed: Dec. 6, 2017

(86) PCT No.: PCT/CN2017/114817
§ 371 (c)(1),
(2) Date: May 15, 2020

(87) PCT Pub. No.: WO2019/095461
PCT Pub. Date: May 23, 2019

(65) Prior Publication Data

US 2020/0383433 A1 Dec. 10, 2020

(30) Foreign Application Priority Data

Nov. 17, 2017 (CN) ..... 201711144663.0

(51) Int. Cl.
*A44B 19/26* (2006.01)
*A44B 19/36* (2006.01)
*A44B 19/40* (2006.01)

(52) U.S. Cl.
CPC ..... *A44B 19/26* (2013.01); *A44B 19/36* (2013.01); *A44B 19/403* (2013.01)

(58) Field of Classification Search
CPC ..... A44B 19/26; A44B 19/36; A44B 19/403; Y10T 24/2509
See application file for complete search history.

(56) References Cited

FOREIGN PATENT DOCUMENTS

| | | | |
|---|---|---|---|
| CN | 102481039 | A | 5/2012 |
| CN | 102525042 | A | 7/2012 |
| CN | 102481039 | B | 10/2014 |
| CN | 205682635 | U | 11/2016 |
| CN | 205757626 | U | 12/2016 |
| CN | 207519744 | U | 6/2018 |
| KR | 101207322 | B1 | 12/2012 |

*Primary Examiner* — Robert Sandy
*Assistant Examiner* — Louis A Mercado
(74) *Attorney, Agent, or Firm* — Bayramoglu Law Offices LLC

(57) ABSTRACT

A dock slider includes a guide column. An upper wing plate and a lower wing plate are connected by the guide column. The guide column is provided on the front end side of the slider. The space formed between the upper wing plate and the lower wing plate forms a sliding groove. An upper guide plate is downwardly and vertically provided from the left edge and the right edge of the upper wing plate, respectively. The upper guide plate is configured to limit the sliding direction of the slider. A lower guide plate is upwardly and vertically provided from the left edge and the right edge of the lower wing plate, respectively. The lower guide plate is configured to limit the sliding direction of the slider and arranged corresponding to the upper guide plate.

9 Claims, 8 Drawing Sheets

DOCK SLIDER

CROSS REFERENCE TO THE RELATED APPLICATIONS

This application is the national phase entry of International Application No. PCT/CN2017/114817, filed on Dec. 6, 2017, which is based upon and claims priority to Chinese Patent Application No. 201711144663.0, filed on Nov. 17, 2017, the entire contents of which are incorporated herein by reference.

TECHNICAL FIELD

The present invention relates to zipper sliders, and more particularly, to a dock slider.

BACKGROUND

With the development of the zipper industry, zipper sliders are increasingly diversifying and improving to be more versatile and attractive. These improvements provide substantial convenience for people's daily life. Zipper slider designs have become more detailed and specialized to meet different demands as a result of advancements in science and technology.

Zippers have more extensive applications with the advent of double-slider zippers. For example, Chinese patent CN 102481039 B, discloses two zipper sliders that are installed on the zipper in opposite directions, and the zipper can be unzipped and zipped in two directions by a specific bottom stop member. Although this zipper can be conveniently used in a garment, the existing double-slider zipper still has some shortcomings when the two sliders are combined for use. For example, the two zipper sliders must be maintained in alignment until the bottom stop member completely passes through the zipper sliders. Otherwise, if the upper zipper slider is not aligned with the lower zipper slider, the bottom stop member cannot smoothly pass through the zipper sliders, which negatively affect zipper function and user expectations.

SUMMARY

The present invention is directed to the above-mentioned problems to improve the structure of the slider, which overcomes the shortcoming that bottom stop member cannot smoothly pass through two sliders. Specifically, the present invention provides a dock slider, including a guide column. An upper wing plate and a lower wing plate are connected by the guide column. The guide column is provided on the front end side of the slider. The space formed between the upper wing plate and the lower wing plate forms a sliding groove. An upper guide plate is downwardly and vertically provided from the left edge and the right edge of the upper wing plate, respectively. The upper guide plate is configured to limit the sliding direction of the slider. A lower guide plate is upwardly and vertically provided from the left edge and the right edge of the lower wing plate, respectively. The lower guide plate is configured to limit the sliding direction of the slider and arranged corresponding to the upper guide plate. The upper wing plate and the lower wing plate are respectively provided with an upper limit portion and a lower limit portion at sites adjacent to the rear end side of the slider. The space surrounded by the upper limit portion and the lower limit portion forms a limit cavity configured to accommodate the rear end side of the slider. The cross-sectional area of the limit cavity is larger than the cross-sectional area of the sliding groove at the rear end side of the slider.

Preferably, the upper limit portion includes two upper clasping bodies symmetrically arranged with respect to the center line of the upper wing plate, and the lower limit portion includes two lower clasping bodies symmetrically arranged with respect to the center line of the lower wing plate.

The limit cavity formed by the two upper clasping bodies and the two lower clasping bodies is rectangular and configured to limit a lateral movement of the rear end side of the slider.

Specifically, by employing the above-mentioned structure, when the two sliders on a double-slider zipper move downward naturally, the tail of the upper slider can be embedded into the rectangular limit cavity to prevent the lateral movement of the upper slider and facilitate the bottom stop member smoothly passing through the sliders.

Preferably, the upper clasping body includes an upper connecting piece. The upper blocking piece and the upper side blocking piece are connected and fixed by the upper connecting piece.

The upper wing plate smoothly extends in a direction away from both the rear end side of the slider and the surface of the upper wing plate to form the upper blocking piece. The upper guide plate extends away from the rear end side of the slider to form the upper side blocking piece corresponding to the outer edge of the upper blocking piece. The upper connecting piece is arranged between the upper blocking piece and the upper side blocking piece and arranged corresponding to the outer edge of the upper blocking piece.

Specifically, the above-mentioned structures ensure the stability of the sliders after the tail end of the slider is embedded and facilitate pulling the lower slider without affecting the use of the entire zipper.

Preferably, the lower clasping body includes a lower connecting piece. The lower blocking piece and the lower side blocking piece are connected and fixed by the lower connecting piece.

The lower wing plate smoothly extends in a direction away from both the rear end side of the slider and the surface of the lower wing plate to form the lower blocking piece. The lower guide plate extends away from the rear end side of the slider to form the lower side blocking piece corresponding to the outer edge of the lower blocking piece. The lower connecting piece is arranged between the lower blocking piece and the lower side blocking piece and arranged corresponding to the outer edge of the lower blocking piece.

Specifically, the above-mentioned structures ensure the stability of the sliders after the tail of the slider is embedded and facilitate pulling the lower slider without affecting the use of the entire zipper.

Preferably, the end of the upper side blocking piece is gradually contracted toward the upper wing plate and connected to the upper connecting piece to form an upper sliding outer arc surface.

Specifically, the above-mentioned structures ensure that the slider can smoothly move up and down the zipper with less resistance, thus without affecting the pulling of the slider. Besides, the tail of the upper slider will be guided into the limit cavity when naturally sliding downward and contacting the lower slider, which eliminates the need to manually adjust the positions of the two sliders.

Preferably, the end of the lower side blocking piece is gradually contracted toward the lower wing plate and connected to the lower connecting piece to form a lower sliding outer arc surface.

Specifically, the above-mentioned structures ensure that the slider can smoothly move up and down the zipper with less resistance to facilitate pulling the slider. Besides, the tail of the upper slider will be guided into the limit cavity when naturally sliding downward and contacting the lower slider, which eliminates the need to manually adjust the positions of the two sliders.

Preferably, an upper sliding strip is provided on the inner side of the upper guide plate along the sliding direction of the slider. The upper sliding strip is connected to both the upper guide plate and the upper wing plate. The end of the upper sliding strip is gradually contracted toward the rear end side of the slider to form an upper sliding inner arc surface.

A lower sliding strip is provided on the inner side of the lower guide plate along the sliding direction of the slider. The lower sliding strip is connected to both the lower guide plate and the lower wing plate. The end of the lower sliding strip is gradually contracted toward the rear end side of the slider to form a lower sliding inner arc surface.

Specifically, the above-mentioned structures ensure that the slider can be guided to smoothly move up and down the zipper without moving laterally, which is convenient for quickly pulling the slider from a specific position along the length direction of the zipper to guide the zipper teeth into the sliding groove without being stuck.

Preferably, the upper wing plate between the two upper sliding inner arc surfaces is provided with an upper rear end slope configured to facilitate sliding the slider. The upper rear end slope is a smooth arc-shaped end surface formed by the inner surface of the upper wing plate gradually contracting toward the outer surface of the upper wing plate.

The lower wing plate between the two lower sliding inner arc surfaces is provided with a lower rear end slope configured to facilitate sliding the slider. The lower rear end slope is a smooth arc-shaped end surface formed by the inner surface of the lower wing plate gradually contracting toward the outer surface of the lower wing plate.

Specifically, by employing the above-mentioned structures, when the slider is moved upward, the zipper teeth can be guided into the sliding groove with less resistance, which is convenient to use.

Preferably, the inner surface of the upper sliding strip adjacent to the rear end side of the slider is provided with an upper opening arc surface configured to reduce the sliding resistance of the slider.

The inner surface of the lower sliding strip adjacent to the rear end side of the slider is provided with a lower opening arc surface configured to reduce the sliding resistance of the slider.

Specifically, the upper opening arc surface cooperates with the lower opening arc surface to accurately guide the zipper teeth into the sliding groove, which ensures a smooth movement of the slider without a lateral movement, and improves the coordination of the two sliders on the double-slider zipper.

Preferably, the upper wing plate is provided with a through hole penetrating from the surface of the upper wing plate to the sliding groove.

Specifically, when the above-mentioned structures are used in a self-locking slider, a self-locking piece extends into the through hole and is engaged with the zipper teeth.

The advantages of the present invention are as follows:

When the slider with the above-mentioned structures is used in a double-slider zipper, the lateral movement of the upper slider can be prevented to facilitate the bottom stop member passing through the two sliders without affecting the movement of the slider on the zipper. Moreover, the slider is structurally designed to restrict the lateral movement of the slider and reduce the resistance when unzipping the zipper, so as to facilitate unzipping the zipper from below.

DETAILED DESCRIPTION OF THE EMBODIMENTS

Figure 1:
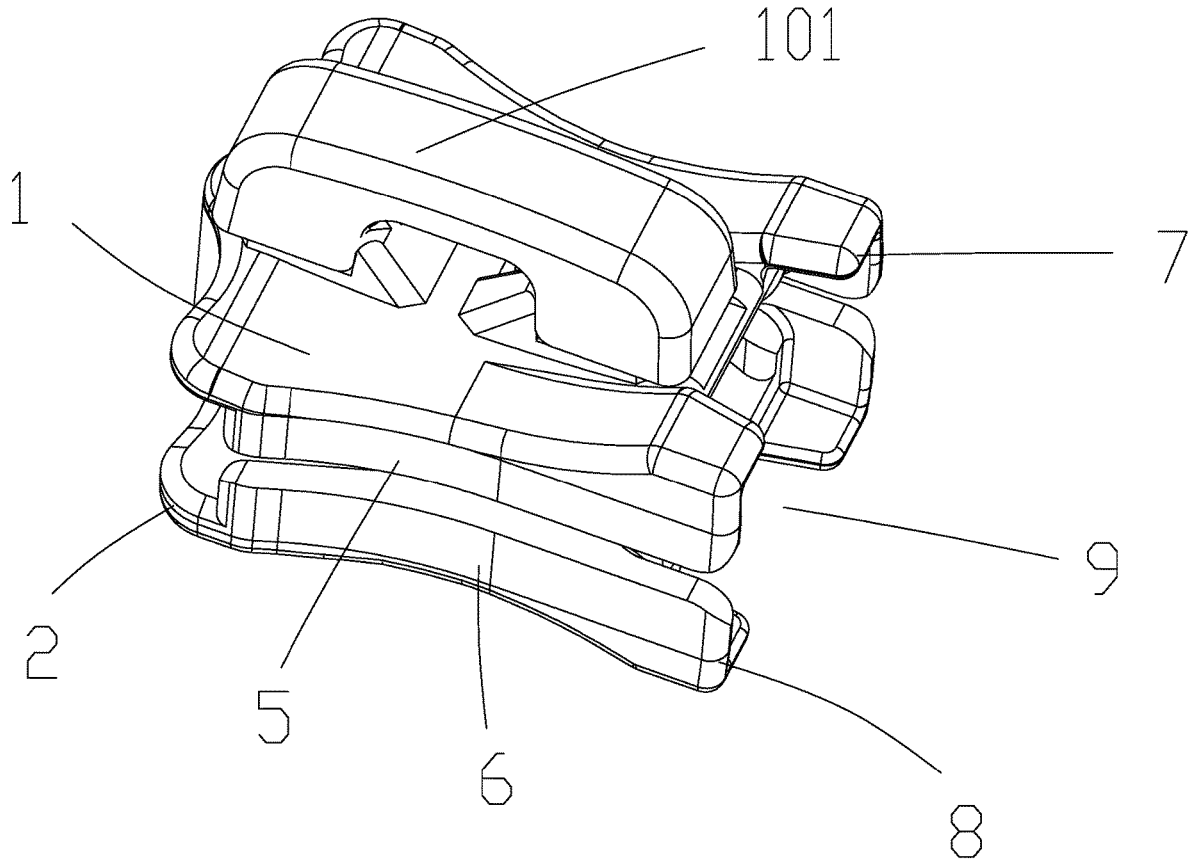
FIG. 1 is a first perspective view showing the dock slider according to an embodiment of the present invention.
Figure 2:
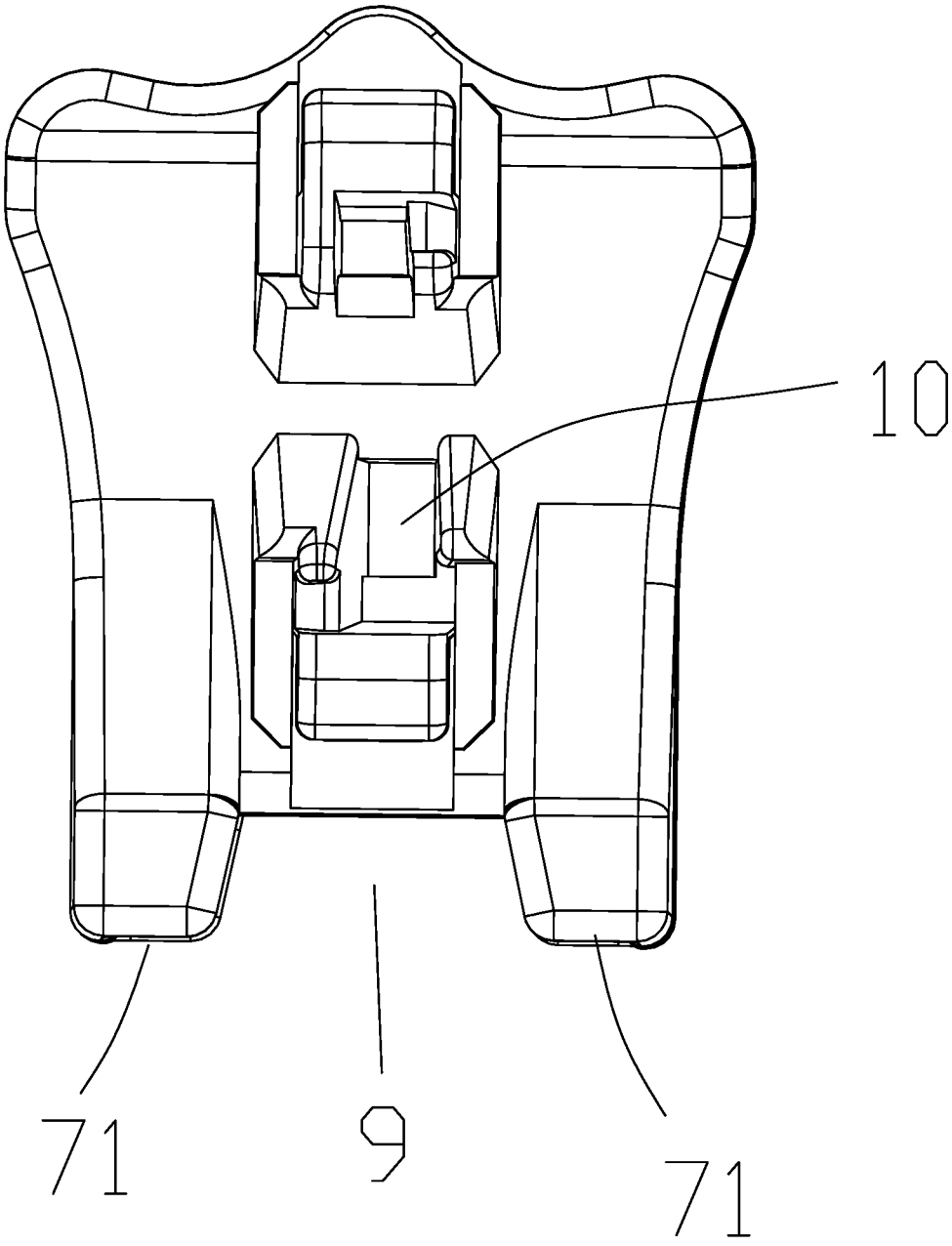
FIG. 2 is a top view of the dock slider according to an embodiment of the present invention.
Figure 3:
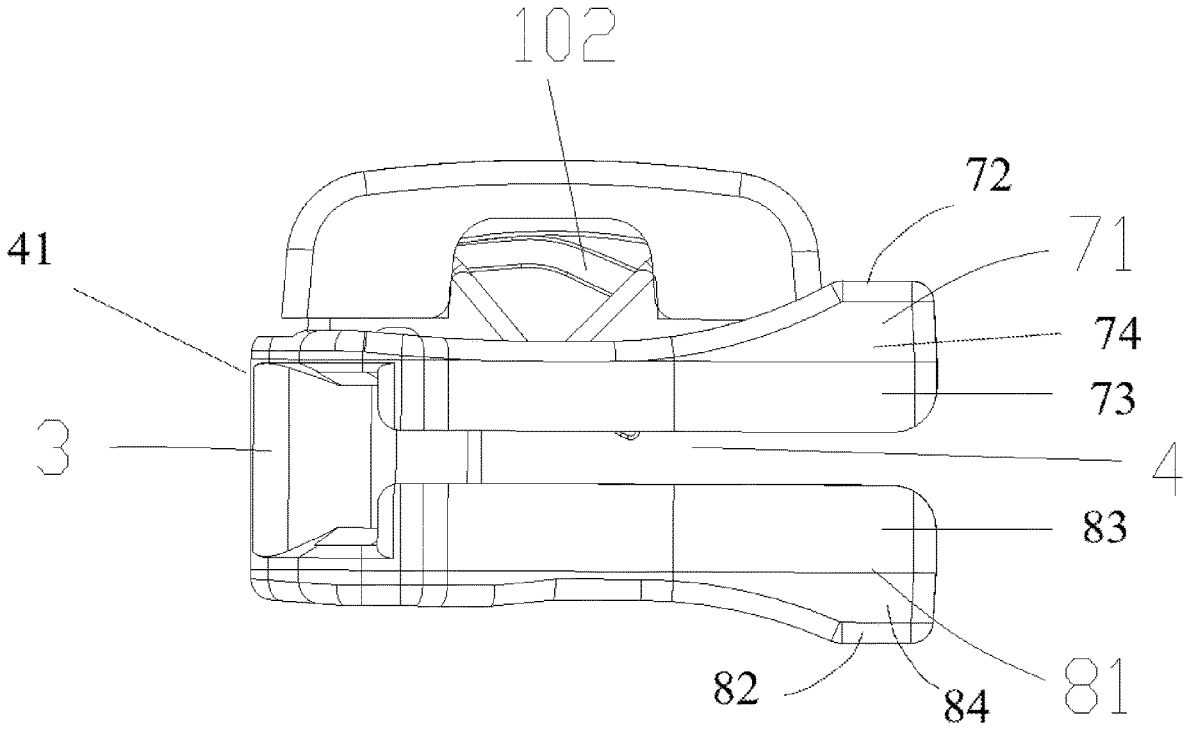
FIG. 3 is a side view of the dock slider according to an embodiment of the present invention.
Figure 4:
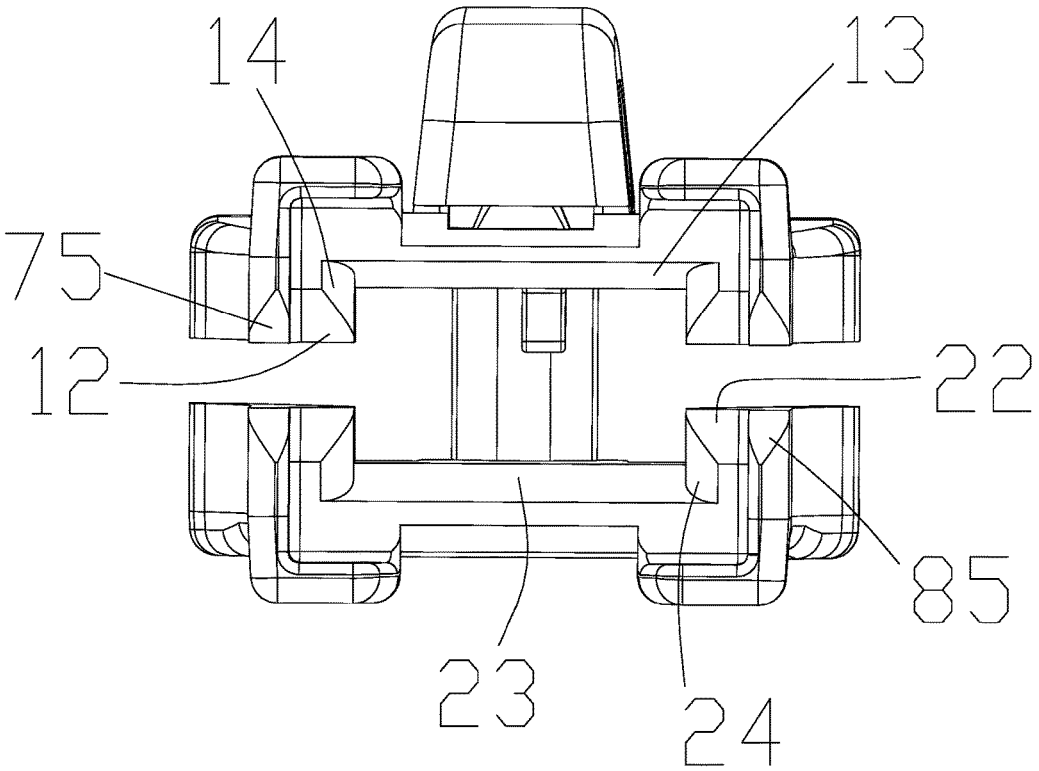
FIG. 4 is a front view of the dock slider according to an embodiment of the present invention.
Figure 5:
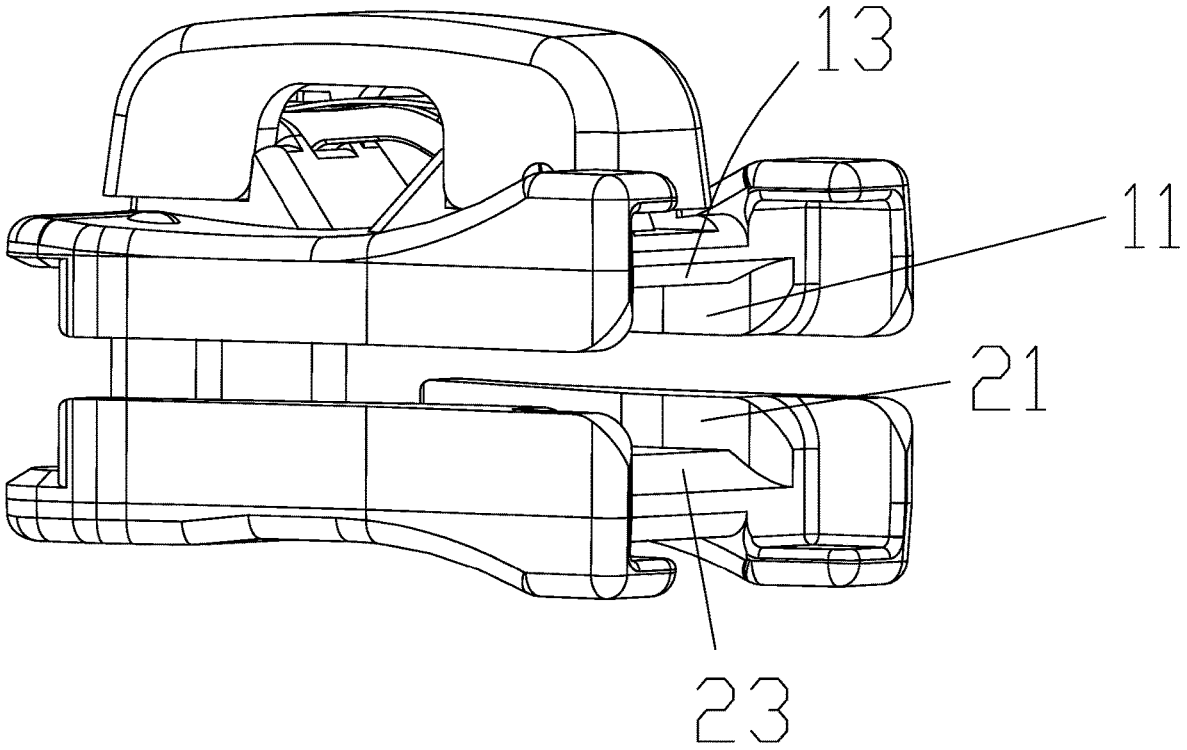
FIG. 5 is a second perspective view showing the dock slider according to an embodiment of the present invention.
Figure 6:
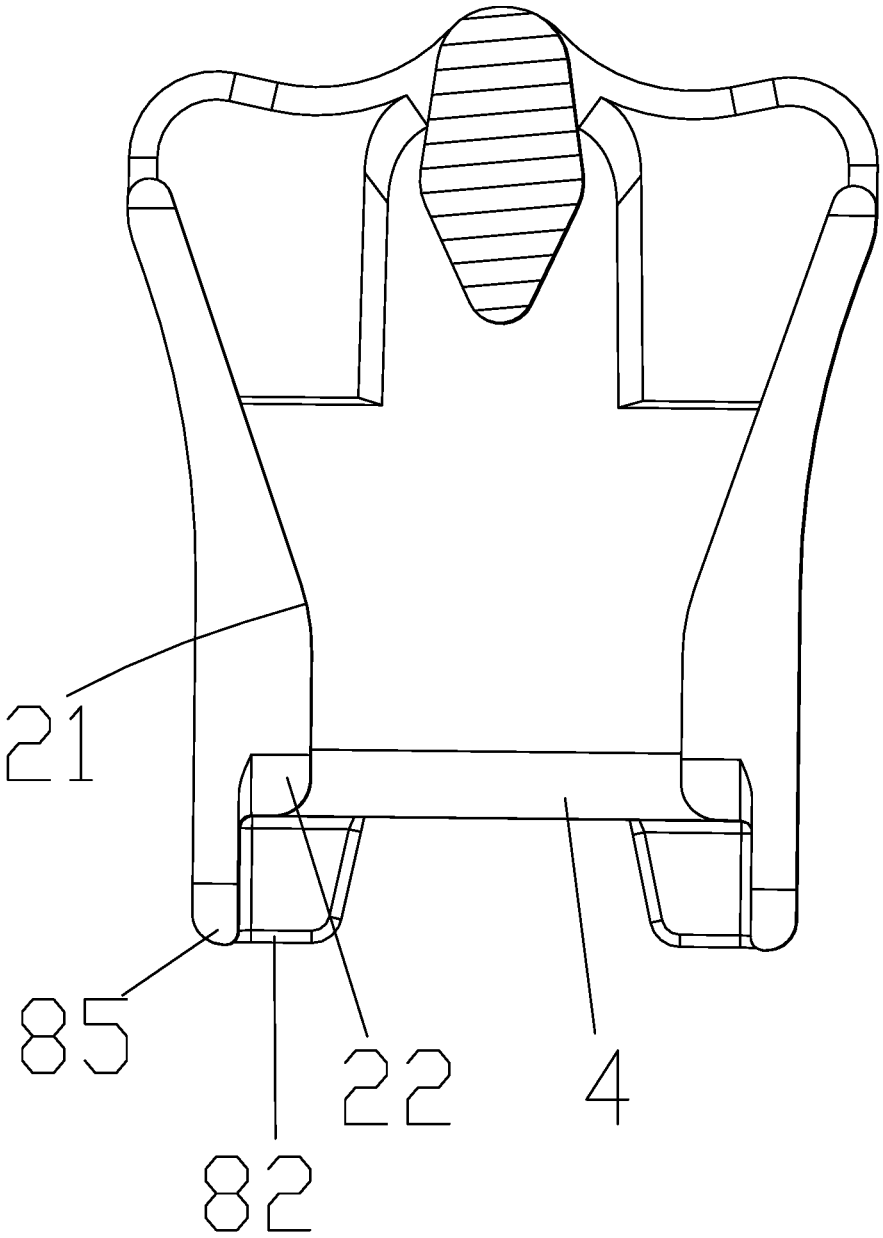
FIG. 6 is a cross-sectional top view of the dock slider taken along a center point of the guide column according to an embodiment of the present invention.
Figure 7:
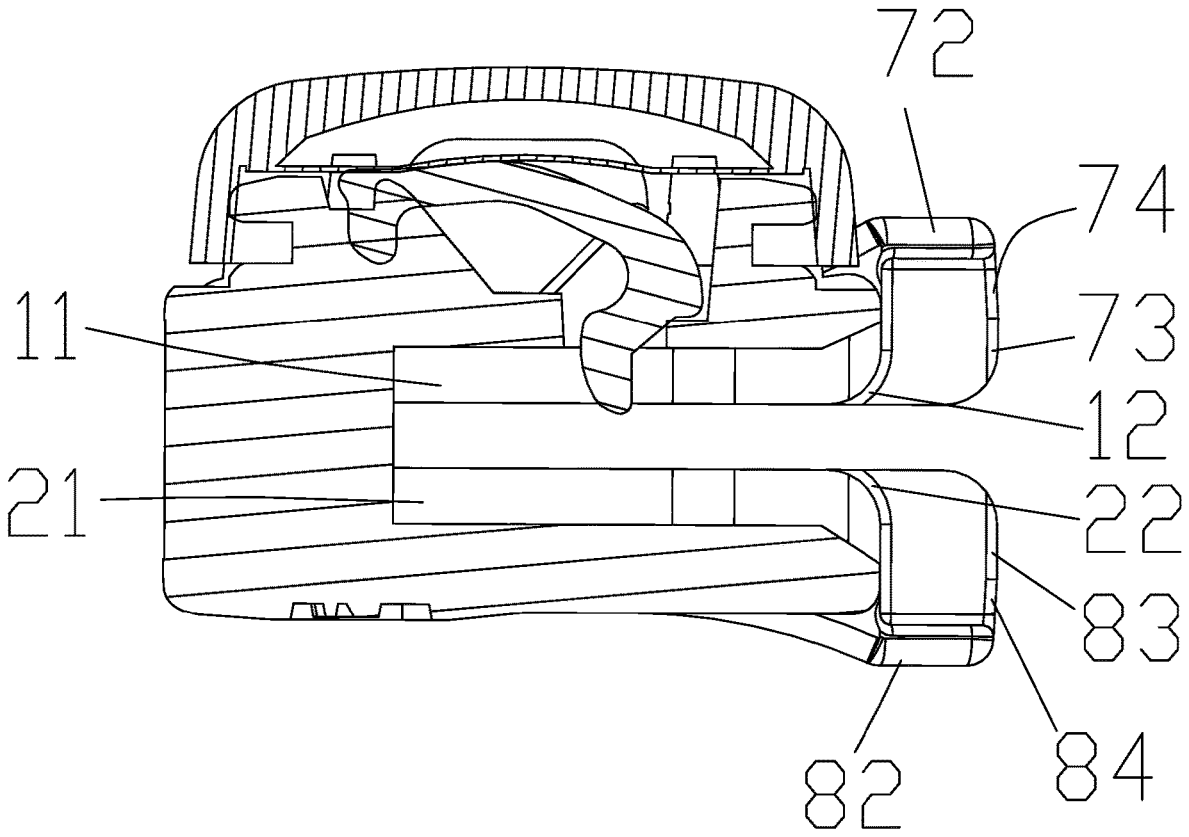
FIG. 7 is a cross-sectional side view of the dock slider taken along a center line of the slider according to an embodiment of the present invention.

The specific embodiments of the present invention will be further described hereinafter with reference to the drawings.

As shown in FIGS. 1-7, the dock slider of the present embodiment includes the guide column 3. The upper wing plate 1 and the lower wing plate 2 are connected by the guide column 3. The guide column 3 is provided on the front end side 41 of the slider. The space formed between the upper wing plate 1 and the lower wing plate 2 forms the sliding groove 4. The upper guide plate 5 is downwardly and vertically provided from the left edge and the right edge of the upper wing plate 1, respectively. The upper guide plate 5 is configured to limit the sliding direction of the slider. The lower guide plate 6 is upwardly and vertically provided from the left edge and the right edge of the lower wing plate 2, respectively. The lower guide plate 6 is configured to limit the sliding direction of the slider and arranged corresponding to the upper guide plate. The upper wing plate 1 is provided with the through hole 10 penetrating from the surface of the upper wing plate 1 to the sliding groove 4. The upper wing plate 1 is provided with the puller holder 101. The puller holder 101 is provided with the self-locking piece 102 extending into the through hole 10.

The upper wing plate 1 and the lower wing plate 2 are respectively provided with the upper limit portion 7 and the lower limit portion 8 at sites adjacent to the rear end side 42 of the slider. The space surrounded by the upper limit portion 7 and the lower limit portion 8 forms the limit cavity 9 configured to accommodate the rear end side 42 of the slider. The cross-sectional area of the limit cavity 9 is larger than the cross-sectional area of the sliding groove 4 at the rear end side 42 of the slider.

The upper limit portion 7 includes two upper clasping bodies 71 symmetrically arranged with respect to the center line of the upper wing plate 1. The lower limit portion 8 includes two lower clasping bodies 81 symmetrically arranged with respect to the center line of the lower wing plate 2.

The limit cavity 9 formed by the two upper clasping bodies 71 and the two lower clasping bodies 81 is rectangular and configured to limit a lateral movement of the rear end side 42 of the slider.

The upper clasping body 71 includes the upper connecting piece 74. The upper blocking piece 72 and the upper side blocking piece 73 are connected and fixed by the upper connecting piece 74.

The upper wing plate 1 smoothly extends in a direction away from both the rear end side 42 of the slider and the surface of the upper wing plate 1 to form the upper blocking piece 72. The upper guide plate 5 extends away from the rear end side 42 of the slider to form the upper side blocking piece 73 corresponding to the outer edge of the upper blocking piece 72. The upper connecting piece 74 is arranged between the upper blocking piece 72 and the upper side blocking piece 73 and arranged corresponding to the outer edge of the upper blocking piece 72.

The end of the upper side blocking piece 73 is gradually contracted toward the upper wing plate 1 and connected to the upper connecting piece 74 to form the upper sliding outer arc surface 75.

The upper sliding strip 11 is provided on the inner side of the upper guide plate 5 along the sliding direction of the slider. The upper sliding strip 11 is connected to both the upper guide plate 5 and the upper wing plate 1. The end of the upper sliding strip 11 is gradually contracted toward the rear end side 42 of the slider to form the upper sliding inner arc surface 12.

The upper wing plate 1 between the two upper sliding inner arc surfaces 12 is provided with the upper rear end slope 13 configured to facilitate sliding the slider. The upper rear end slope 13 is a smooth arc-shaped end surface formed by the inner surface of the upper wing plate 1 gradually contracting toward the outer surface of the upper wing plate 1.

The inner surface of the upper sliding strip 11 adjacent to the rear end side 42 of the slider is provided with the upper opening arc surface 14 configured to reduce the sliding resistance of the slider.

The lower clasping body 81 includes the lower connecting piece 84. The lower blocking piece 82 and the lower side blocking piece 83 are connected and fixed by the lower connecting piece 84.

The lower wing plate 2 smoothly extends in a direction away from both the rear end side 42 of the slider and the surface of the lower wing plate 2 to form the lower blocking piece 82. The lower guide plate 6 extends away from the rear end side 42 of the slider to form the lower side blocking piece 83 corresponding to the outer edge of the lower blocking piece 82. The lower connecting piece 84 is arranged between the lower blocking piece 82 and the lower side blocking piece 83 and arranged corresponding to the outer edge of the lower blocking piece 82.

The end of the lower side blocking piece 83 is gradually contracted toward the lower wing plate 2 and connected to the lower connecting piece 84 to form the lower sliding outer arc surface 85.

The lower sliding strip 21 is provided on the inner side of the lower guide plate 6 along the sliding direction of the slider. The lower sliding strip 21 is connected to both the lower guide plate 6 and the lower wing plate 2. The end of the lower sliding strip 21 is gradually contracted toward the rear end side 42 of the slider to form the lower sliding inner arc surface 22.

The lower wing plate 2 between the two lower sliding inner arc surfaces 22 is provided with the lower rear end slope 23 configured to facilitate sliding the slider. The lower rear end slope 23 is a smooth arc-shaped end surface formed by the inner surface of the lower wing plate 2 gradually contracting toward the outer surface of the lower wing plate 2.

The inner surface of the lower sliding strip 21 adjacent to the rear end side 42 of the slider is provided with the lower opening arc surface 24 configured to reduce the sliding resistance of the slider.

Figure 8:
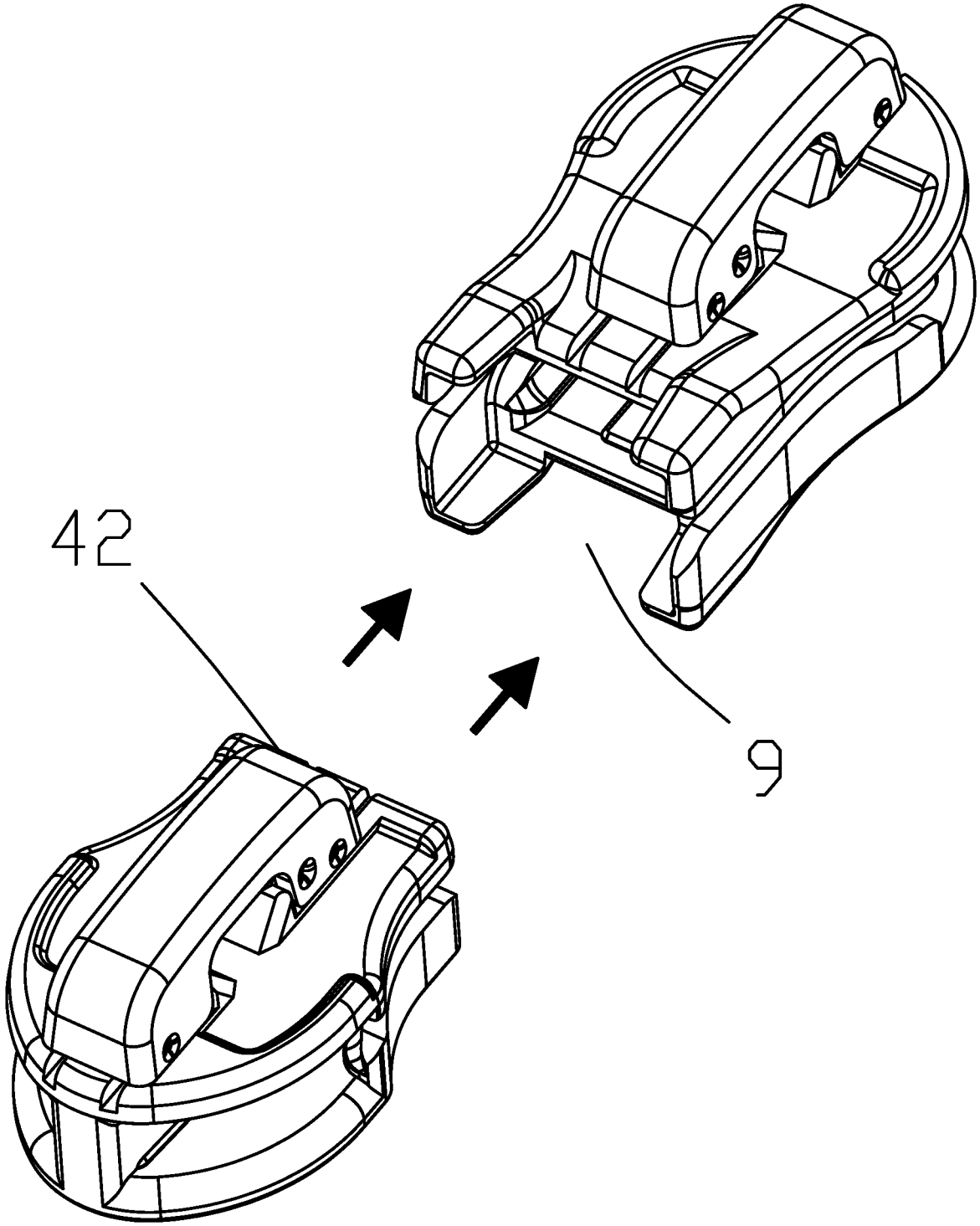
FIG. 8 is a first schematic diagram showing the combination of the dock slider and an ordinary slider.
Figure 9:
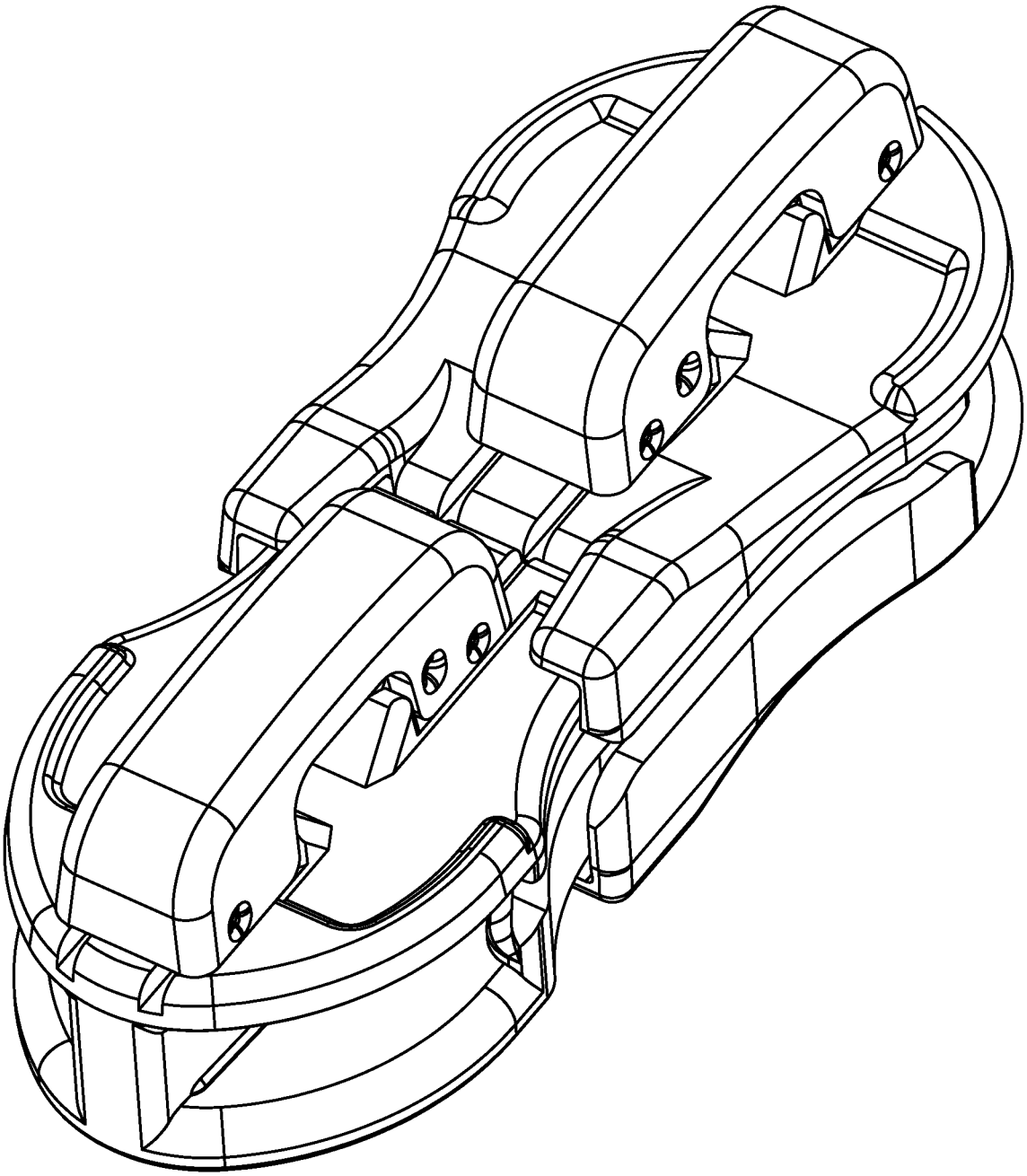
FIG. 9 is a second schematic diagram showing the combination of the dock slider and the ordinary slider.

As shown in FIGS. 8-9, when the slider in the present embodiment is combined with an ordinary slider, the rear end side of the ordinary slider is accommodated in the limit cavity 9. The rear end side of the ordinary slider can easily slide into the limit cavity 9 by the upper clasping body 71 and the lower clasping body 81 without being separated and misaligned. In this way, when the double-slider zipper is in use, the bottom stop member easily passes through the sliding grooves of the two sliders at the same time, which is user-friendly.

According to the disclosure and teachings of the above description, those skilled in the art can also make changes and modifications to the above-mentioned embodiments. However, the present invention is not limited to the specific embodiments described above, and these modifications and changes made to the present invention shall fall within the scope of protection of the claims of the present invention. In addition, although some specific terminologies are used in the present invention, these terminologies are only intended to facilitate the description, rather than limit the present invention.

What is claimed is:

1. A dock slider, comprising:

a guide column;

wherein an upper wing plate and a lower wing plate are connected by the guide column; the guide column is provided on a front end side of the dock slider; a space formed between the upper wing plate and the lower wing plate forms a sliding groove; an upper guide plate is downwardly and vertically provided from a left edge and a right edge of the upper wing plate, respectively; the upper guide plate is configured to limit a sliding direction of the dock slider; a lower guide plate is upwardly and vertically provided from a left edge and a right edge of the lower wing plate, respectively; the lower guide plate is configured to limit the sliding direction of the dock slider and arranged corresponding to the upper guide plate; the upper wing plate and the lower wing plate are respectively provided with an upper limit portion and a lower limit portion at sites adjacent to a rear end side of the dock slider; a space surrounded by the upper limit portion and the lower limit portion forms a limit cavity configured to accommodate the rear end side of the dock slider; a cross-sectional area of the limit cavity is larger than a cross-sectional area of the sliding groove at the rear end side of the dock slider, an upper sliding strip is provided on an inner side of the upper guide plate along the sliding direction of the dock slider; the upper sliding strip is connected to both the upper guide plate and the upper wing plate; ends of the upper sliding strip are gradually contracted toward the rear end side of the dock slider to form two upper sliding inner arc surfaces, a lower sliding strip is provided on an inner side of the lower guide plate along the sliding direction of the dock slider; the lower sliding strip is connected to both the lower guide plate and the lower wing plate; ends of the lower sliding strip are gradually contracted toward the rear end side of the dock slider to form two lower sliding inner arc surfaces, an inner surface of the upper sliding strip is provided with an upper opening arc surface configured to reduce a sliding resistance of the dock slider, wherein the inner surface of the upper sliding strip is adjacent to the rear end side of the dock slider, and an inner surface of the lower sliding strip is provided with a lower opening arc surface configured to reduce the sliding resistance of the dock slider, wherein the inner surface of the lower sliding strip is adjacent to the rear end side of the dock slider.

2. The dock slider according to claim 1, wherein, the upper limit portion comprises two upper clasping bodies, wherein the two upper clasping bodies are symmetrically arranged with respect to a center line of the upper wing plate, and the lower limit portion comprises two lower clasping bodies, wherein the two lower clasping bodies are symmetrically arranged with respect to a center line of the lower wing plate; and the limit cavity is rectangular and configured to limit a lateral movement of the rear end side of the dock slider.

3. The dock slider according to claim 2, wherein, each lower clasping body of the two lower clasping bodies comprises a lower connecting piece; a lower blocking piece and a lower side blocking piece are connected and fixed by the lower connecting piece; and the lower wing plate smoothly extends in a direction away from both the rear end side of the dock slider and a surface of the lower wing plate to form the lower blocking piece; the lower guide plate extends away from the rear end side of the dock slider to form the lower side blocking piece corresponding to an outer edge of the lower blocking piece; the lower connecting piece is arranged between the lower blocking piece and the lower side blocking piece and arranged corresponding to the outer edge of the lower blocking piece.

4. The dock slider according to claim 2, wherein, each upper clasping body of the two upper clasping bodies comprises an upper connecting piece; an upper blocking piece and an upper side blocking piece are connected and fixed by the upper connecting piece; and the upper wing plate smoothly extends in a direction away from both the rear end side of the dock slider and a surface of the upper wing plate to form the upper blocking piece; the upper guide plate extends away from the rear end side of the dock slider to form the upper side blocking piece corresponding to an outer edge of the upper blocking piece; the upper connecting piece is arranged between the upper blocking piece and the upper side blocking piece and arranged corresponding to the outer edge of the upper blocking piece.

5. The dock slider according to claim 4, wherein, an end of the upper side blocking piece is gradually contracted toward the upper wing plate and connected to the upper connecting piece to form an upper sliding outer arc surface.

6. The dock slider according to claim 4, wherein, each lower clasping body of the two lower clasping bodies comprises a lower connecting piece; a lower blocking piece and a lower side blocking piece are connected and fixed by the lower connecting piece; and the lower wing plate smoothly extends in a direction away from both the rear end side of the dock slider and a surface of the lower wing plate to form the lower blocking piece; the lower guide plate extends away from the rear end side of the dock slider to form the lower side blocking piece corresponding to an outer edge of the lower blocking piece; the lower connecting piece is arranged between the lower blocking piece and the lower side blocking piece and arranged corresponding to the outer edge of the lower blocking piece.

7. The dock slider according to claim 3, wherein, an end of the lower side blocking piece is gradually contracted toward the lower wing plate and connected to the lower connecting piece to form a lower sliding outer arc surface.

8. The dock slider according to claim 1, wherein, the upper wing plate is provided with a through hole, wherein the through hole penetrates from a surface of the upper wing plate to the sliding groove.

9. A dock slider, comprising:

a guide column;

wherein an upper wing plate and a lower wing plate are connected by the guide column; the guide column is provided on a front end side of the dock slider; a space formed between the upper wing plate and the lower wing plate forms a sliding groove; an upper guide plate is downwardly and vertically provided from a left edge and a right edge of the upper wing plate, respectively; the upper guide plate is configured to limit a sliding direction of the dock slider; a lower guide plate is upwardly and vertically provided from a left edge and a right edge of the lower wing plate, respectively; the lower guide plate is configured to limit the sliding direction of the dock slider and arranged corresponding to the upper guide plate; the upper wing plate and the lower wing plate are respectively provided with an upper limit portion and a lower limit portion at sites adjacent to a rear end side of the dock slider; a space surrounded by the upper limit portion and the lower limit portion forms a limit cavity configured to accommodate the rear end side of the dock slider; a cross-sectional area of the limit cavity is larger than a cross-sectional area of the sliding groove at the rear end side of the dock slider, an upper sliding strip is provided on an inner side of the upper guide plate along the sliding direction of the dock slider; the upper sliding strip is connected to both the upper guide plate and the upper wing plate; ends of the upper sliding strip are gradually contracted toward the rear end side of the dock slider to form two upper sliding inner arc surfaces;

a lower sliding strip is provided on an inner side of the lower guide plate along the sliding direction of the dock slider; the lower sliding strip is connected to both the lower guide plate and the lower wing plate; ends of the lower sliding strip are gradually contracted toward the rear end side of the dock slider to form two lower sliding inner arc surfaces, a portion of the upper wing plate between the two upper sliding inner arc surfaces is provided with an upper rear end slope configured to facilitate sliding the dock slider; the upper rear end slope is a first smooth arc-shaped end surface, wherein an inner surface of the upper wing plate is gradually contracted toward an outer surface of the upper wing plate to form the first smooth arc-shaped end surface, a portion of the lower wing plate between the two lower sliding inner arc surfaces is provided with a lower rear end slope configured to facilitate sliding the dock slider; the lower rear end slope is a second smooth arc-shaped end surface, wherein an inner surface of the lower wing plate is gradually contracted toward an outer surface of the lower wing plate to form the second smooth arc-shaped end surface, an inner surface of the upper sliding strip is provided with an upper opening arc surface configured to reduce a sliding resistance of the dock slider, wherein the inner surface of the upper sliding strip is adjacent to the rear end side of the dock slider, and an inner surface of the lower sliding strip is provided with a lower opening arc surface configured to reduce the sliding resistance of the dock slider, wherein the inner surface of the lower sliding strip is adjacent to the rear end side of the dock slider.

* * * * *